US007785111B2

(12) United States Patent
Hilty et al.

(10) Patent No.: US 7,785,111 B2
(45) Date of Patent: Aug. 31, 2010

(54) ELECTRICAL CONNECTOR WITH ELASTOMERIC ELEMENT

(75) Inventors: Robert Daniel Hilty, Harrisburg, PA (US); Jeffrey George Pennypacker, Corning, NY (US); Jason M'Cheyne Reisinger, Carlisle, PA (US); Jeffrey Byron McClinton, Harrisburg, PA (US); David Beatty Sinisi, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 368 days.

(21) Appl. No.: 11/895,347

(22) Filed: Aug. 24, 2007

(65) Prior Publication Data

US 2009/0050358 A1 Feb. 26, 2009

(51) Int. Cl.
*H01R 12/00* (2006.01)

(52) U.S. Cl. ..... 439/66; 439/91; 439/591

(58) Field of Classification Search ..... 439/66, 439/91, 591

See application file for complete search history.

(56) References Cited

U.S. PATENT DOCUMENTS

| | | | | |
|---|---|---|---|---|
| 7,021,941 | B1 * | 4/2006 | Chuang et al. | 439/66 |
| 7,070,420 | B1 | 7/2006 | Wakefield et al. | |
| 7,331,796 | B2 * | 2/2008 | Hougham et al. | 439/66 |
| 7,491,067 | B2 * | 2/2009 | Hougham et al. | 439/66 |
| 2008/0227307 | A1 * | 9/2008 | Alden et al. | 439/66 |
| 2009/0081891 | A1 * | 3/2009 | Hougham et al. | 439/66 |
| 2009/0181559 | A1 * | 7/2009 | Malstrom et al. | 439/66 |

* cited by examiner

*Primary Examiner*—Gary F. Paumen

(57) ABSTRACT

An electrical connector is provided. The electrical connector includes a substrate and an elastomeric element extending outwardly from the substrate. The elastomeric element extends outwardly from a base portion thereof at the substrate to an end portion thereof that is opposite the base portion. An electrical contact engages an electrically conductive element of the substrate. The electrical contact has a portion extending over at least a portion of the end portion of the elastomeric element.

19 Claims, 8 Drawing Sheets

ELECTRICAL CONNECTOR WITH ELASTOMERIC ELEMENT

BACKGROUND OF THE INVENTION

The invention relates generally to electrical connectors, and more particularly, to electrical connectors having elastomeric elements.

Interconnect devices are sometimes used to provide electrical connection between different electrical components, such as, but not limited to, integrated circuits and printed circuit boards, for example when removal, replacement, and/or testing of the electrical components is desired. Many of these electrical components have electrical contacts arranged in a "land grid array" (LGA) which is a two-dimensional array of contact pads. One type of interconnect device, known as an "interposer", has an array of compressible contacts which is placed between the two opposing arrays of the electrical components to provide an electrical connection between the electrical contacts of the opposing arrays.

Establishing reliable contact between the electrical contacts of the opposing electrical component arrays and the electrical contacts of the interposer may sometimes be difficult due to, for example, height variations between electrical contacts of the opposing electrical component arrays and/or the electrical contacts of the interposer. Variations in thickness and/or warping of any of the substrates supporting the opposing electrical contact arrays and the interposer may also cause difficulty establishing reliable contact. Many interconnect devices use elastomeric elements that are compressed between the electrical contacts of the opposing electrical component arrays such that the elastomeric elements apply a mechanical force to the electrical contacts to facilitate establishing and maintaining reliable electrical contact between the opposing electrical component arrays. Compression of the elastomeric elements also allows for some degree of non-planarity between, and/or misalignment of, the electrical contacts of the opposing electrical component arrays that may be caused by the warping, variations of height, and/or variations of thickness described above.

Some known electrical connectors that include elastomeric elements use elastomeric electrical contacts that typically include an elastomeric body and electrically conducting pathway. Some known elastomeric electrical contacts, sometimes referred to as "filled elastomers", include an elastomeric body having an interior that is filled with one or more electrically conducting materials. However, filled elastomers may have a limited elastic working range because of the amount of conducting filler needed to reach the percolation threshold and conduct a predetermined amount of electrical current, which may increase contact forces above desired levels and/or may deleteriously impact the stress relaxation response of the elastomer. Other known elastomeric electrical contacts include an elastomeric body that includes an electrically conductive pathway formed on an exterior of the elastomeric body. Elastomeric electrical contacts having an electrically conductive pathway on an exterior thereof may have a higher elastic working range than filled elastomeric electrical contacts. However, the electrically conductive pathway may have a lower current carrying capability than filled elastomeric electrical contacts. For example, the dimensions of the electrically conductive pathway may be limited by the desired elastic working range of the elastomeric body. Specifically, if the electrically conductive pathway is formed too large, it may limit the elastic working range of the elastomeric body or the electrically conductive pathway. However, if the conductive pathway is formed too small, it may not carry a desired level of electrical current.

What is needed therefore is an electrical connector that includes electrical contacts that have a higher current carrying capability than known elastomeric electrical contacts while maintaining a predetermined elastic working range of an elastomeric element of the connector.

BRIEF DESCRIPTION OF THE INVENTION

In one embodiment, an electrical connector is provided. The electrical connector includes a substrate and an elastomeric element extending outwardly from the substrate. The elastomeric element extends outwardly from a base portion thereof at the substrate to an end portion thereof that is opposite the base portion. An electrical contact engages an electrically conductive element of the substrate. The electrical contact has a portion extending over at least a portion of the end portion of the elastomeric element.

In another embodiment, an interposer is provided for electrically connecting a pair of electrical components. The interposer includes a substrate having first and second opposite side portions. A first elastomeric element extends outwardly from the substrate on the first side portion. The first elastomeric element extends outwardly from a first base portion thereof at the substrate to a first end portion thereof that is opposite the first base portion. A second elastomeric element extends outwardly from the substrate on the second side portion. The second elastomeric element extends outwardly from a second base portion thereof at the substrate to a second end portion thereof that is opposite the second base portion. A first electrical contact section engages a first electrically conductive element of the first side portion of the substrate. The first electrical contact section extends over at least a portion of the first end portion of the first elastomeric element. A second electrical contact section engages a second electrically conductive element of the second side portion of the substrate. The second electrical contact section extends over at least a portion of the second end portion of the second elastomeric element.

In another embodiment, an interposer is provided for electrically connecting a pair of electrical components. The interposer includes a substrate having first and second opposite side portions, a first through hole extending through the substrate from the first side portion to the second side portion, and a second through hole extending through the substrate from the first side portion to the second side portion. A first elastomeric element extends outwardly from the substrate on the first side portion. The first elastomeric element extends outwardly from a first base portion thereof at the substrate to a first end portion thereof that is opposite the first base portion. A second elastomeric element extends outwardly from the substrate on the second side portion. The second elastomeric element extends outwardly from a second base portion thereof at the substrate to a second end portion thereof that is opposite the second base portion. An electrical contact extends through both of the first and second through holes. The electrical contact includes a first portion extending over at least a portion of the first end portion of the first elastomeric element and a second portion extending over at least a portion of the second end portion of the second elastomeric element.

DETAILED DESCRIPTION OF THE INVENTION

Figure 1:
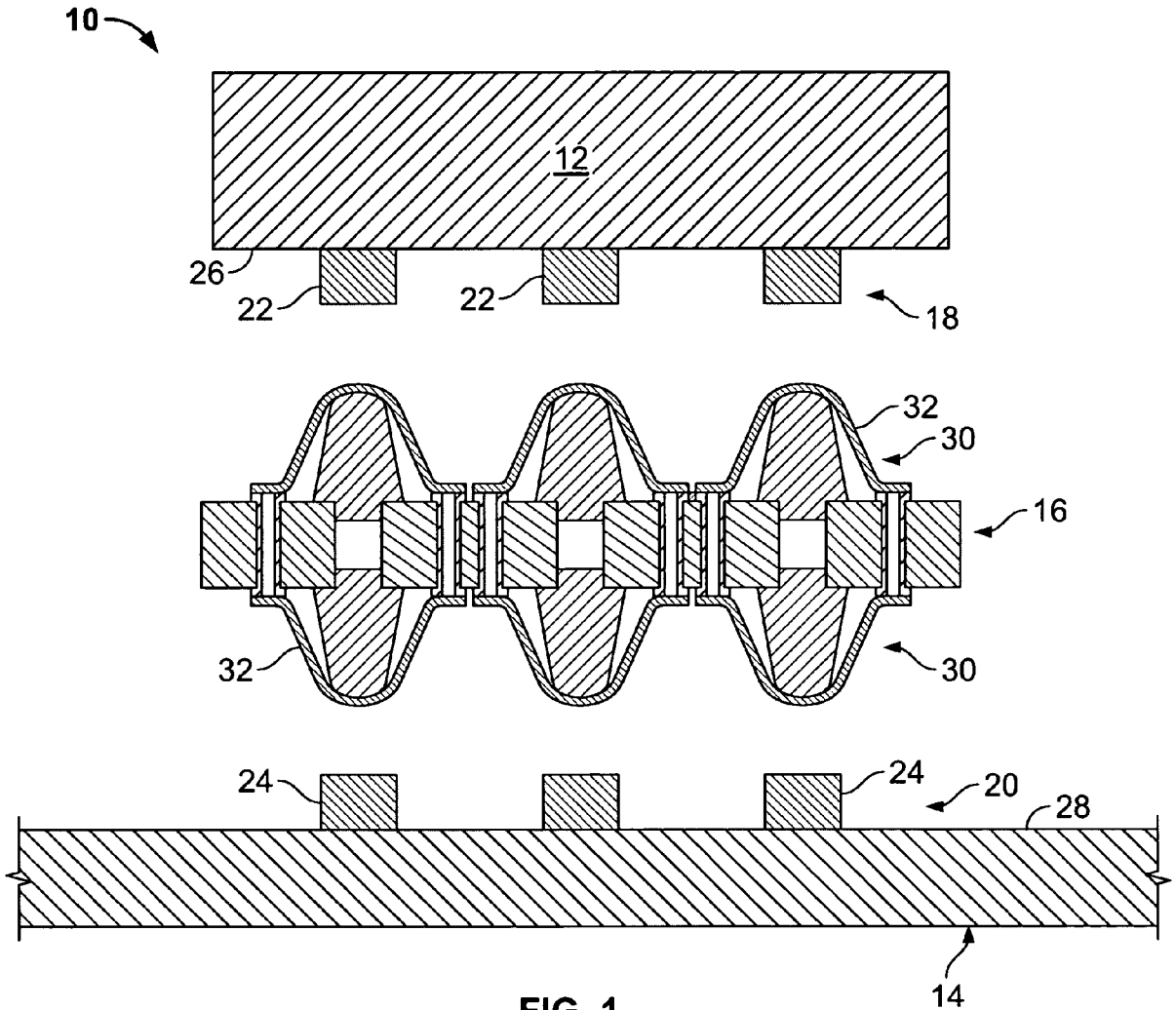
FIG. 1 is an exploded cross-sectional view of an exemplary embodiment of an electrical component assembly.

FIG. 1 is an exploded cross-sectional view of an exemplary embodiment of an electrical component assembly 10. The assembly 10 includes a pair of electrical components 12 and 14 and an interposer 16 for electrically connecting the electrical components 12 and 14 together. The electrical components 12 and 14 each include a respective array 18 and 20 of a plurality of electrical contacts 22 and 24 on opposing surfaces 26 and 28 thereof, respectively. The array 18 of the electrical component 12 substantially matches the pattern of the array 20 of the electrical component 14. The interposer 16 includes a pair of opposite arrays 30 of a plurality of electrical contacts 32 for electrically connecting the arrays 18 and 20 of the electrical components 12 and 14 together. The arrays 30 of the interposer 16 substantially match the pattern of the arrays 18 and 20 of the electrical components 12 and 14, respectively.

The electrical components 12 and 14 may each be any suitable type of electrical component, such as, but not limited to, printed circuit boards, integrated circuits, electrical modules, other electrical devices, and/or the like. The arrays 18 and 20 may each be any suitable type of array of electrical contacts that enables operative electrical connection between the electrical components 12 and 14, such as, but not limited to, Pin Grid Arrays (PGAs), Land Grid Arrays (LGAs), and/or Ball Grid Arrays (BGAs). Moreover, the arrays 18 and 20 may have any suitable configuration, arrangement, and/or pattern of electrical contacts that enables operative electrical connection between the electrical components 12 and 14.

Figure 2:
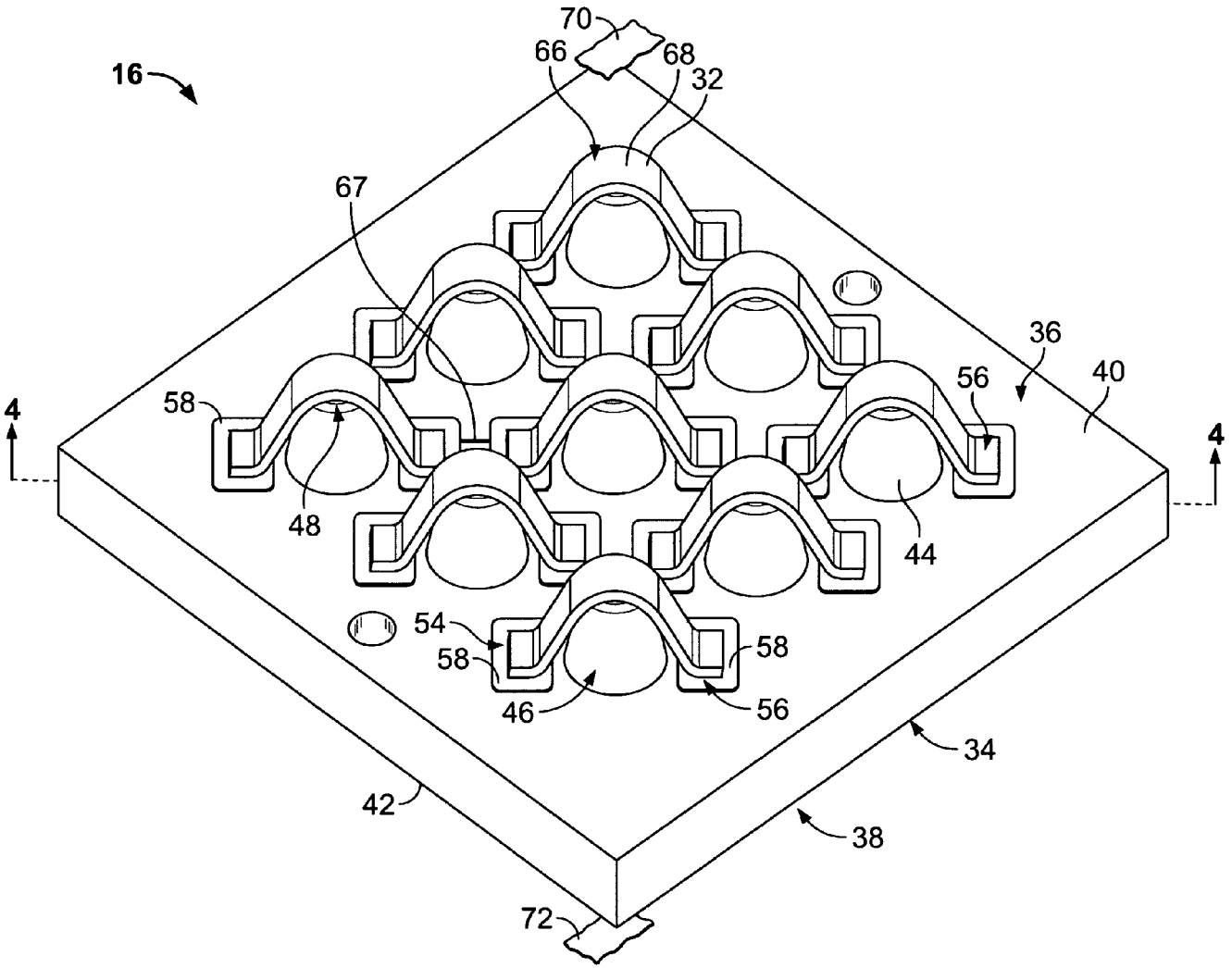
FIG. 2 is a perspective view of an exemplary embodiment of an interposer of the electrical component assembly shown in FIG. 1.
Figure 3:
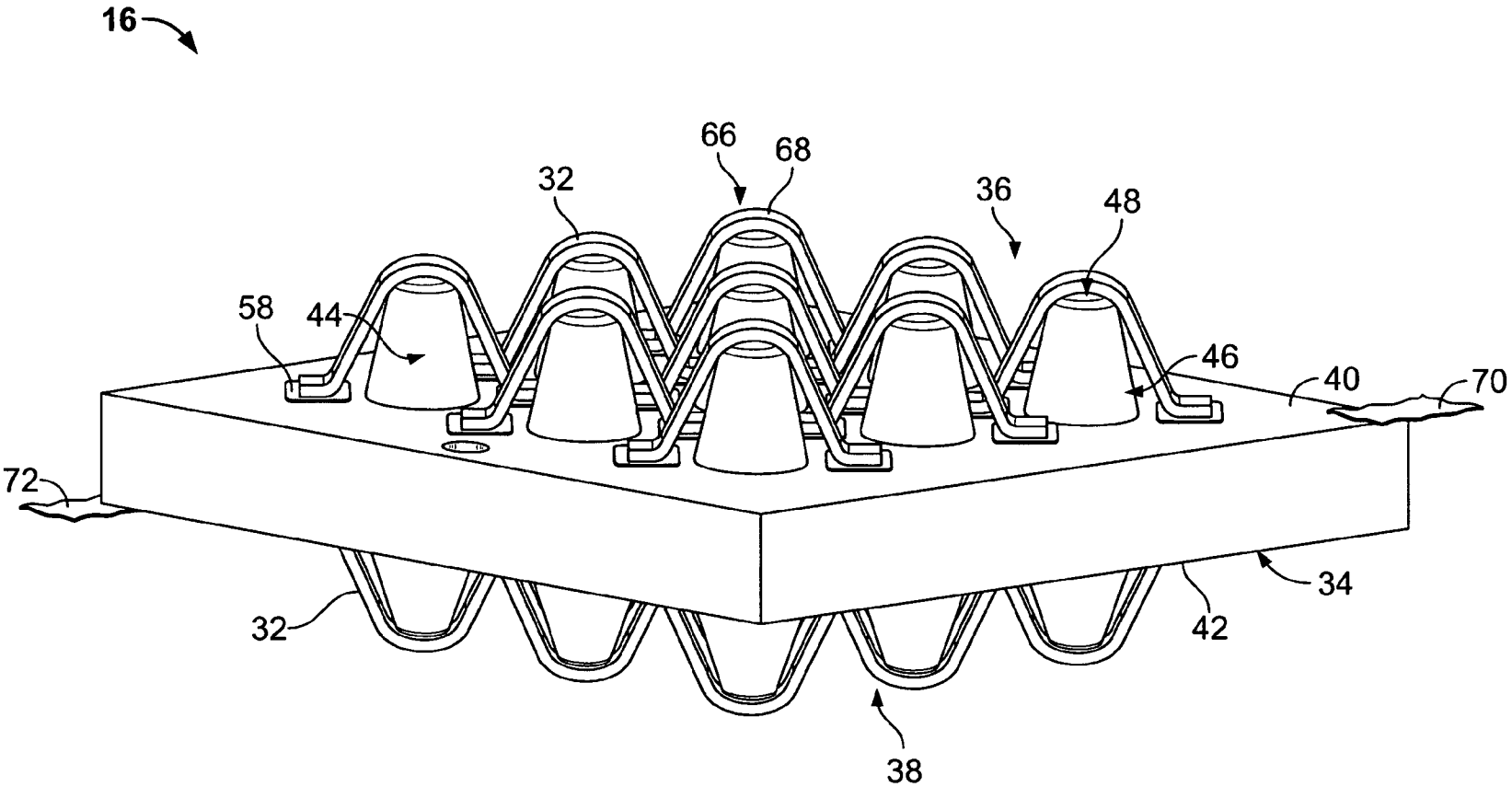
FIG. 3 is another perspective view of the interposer shown in FIGS. 1 and 2.
Figure 4:
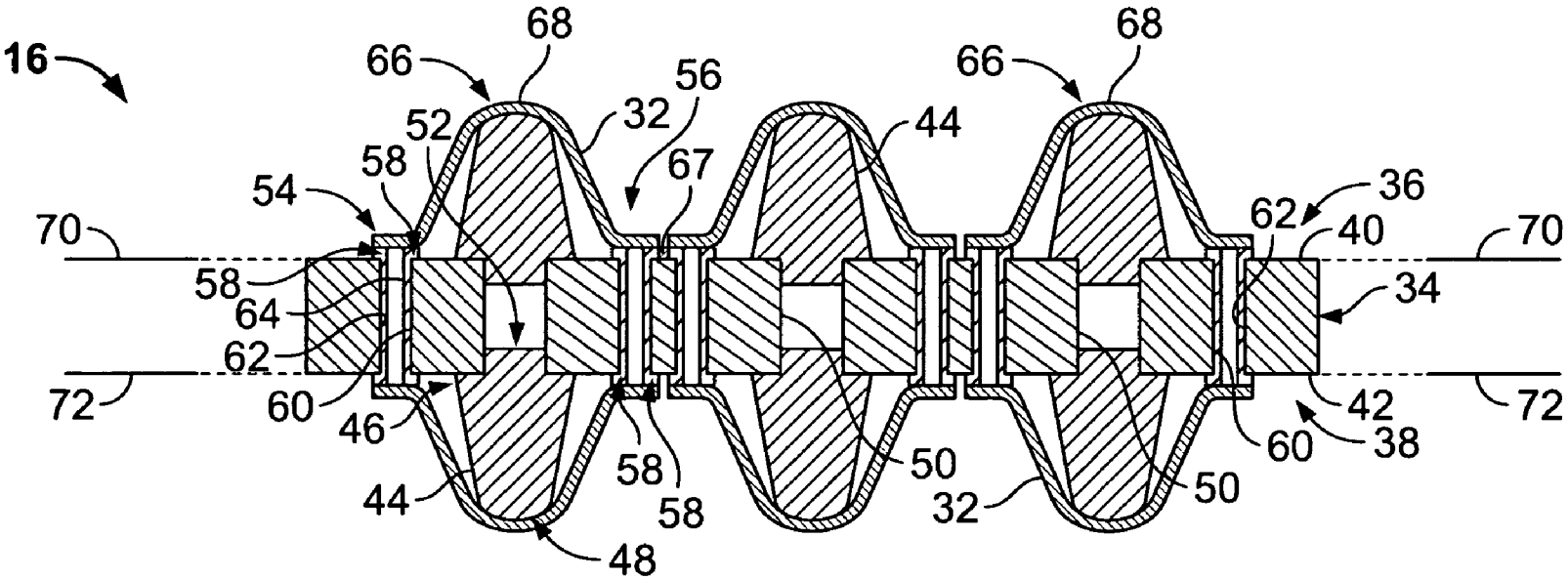
FIG. 4 is a cross-sectional view of the interposer shown in FIGS. 1-3 taken along line 4-4 of FIG. 2.

FIGS. 2 and 3 are perspective views of an exemplary embodiment of the interposer 16. FIG. 4 is a cross-sectional view of the interposer 16 taken along line 4-4 of FIG. 2. The interposer 16 includes a substrate 34 having opposite side portions 36 and 38. The side portions 36 and 38 each include opposite exterior surfaces 40 and 42, respectively, of the substrate 34. The substrate 34 also includes a plurality of elastomeric elements 44 extending outwardly from the substrate 34 on the side portions 36 and 38. The elastomeric elements 44 are compressible such that they apply a mechanical force to the electrical contacts 22 and 24 (FIG. 1) of the arrays 18 and 20 (FIG. 1), respectively, when the electrical components 12 and 14 are mechanically connected together.

Each elastomeric element 44 extends outwardly from a base portion 46 thereof at the substrate 34 to an end portion 48 thereof that is opposite the base portion 46. The elastomeric elements 44 are substantially identical, except for their locations on the corresponding side portion 36 or 38 of the substrate 34. Specifically, each elastomeric element 44 on the side portion 36 includes a substantially identical elastomeric element 44 opposite thereto on the side portion 34. In the exemplary embodiment, the substrate 34 includes a plurality of through holes 50 (FIG. 4) that each receive a stem portion 52 (FIG. 4) of the base portion 46 of two elastomeric elements 44 that are opposite one another on the side portions 36 and 38. The holes 50 are arranged in a pattern that substantially matches the pattern of each of the electrical contact arrays 18 and 20 of the electrical components 12 and 14, respectively. In the exemplary embodiment, the elastomeric elements 44 are partially received within the corresponding through holes 50 to facilitate fastening the elastomeric elements 44 to the substrate 34 and aligning each elastomeric element 44 with the pattern of the corresponding array 18 and/or 20. Additionally or alternatively, each elastomeric element 44 may be fastened to the substrate 34 using any suitable fastener, such as, but not limited to, an adhesive. The two substantially identical elastomeric elements 44 located opposite one another on the side portions 36 and 38 of the substrate 34 may optionally be connected together at the base portions 46 thereof such that the opposite elastomeric elements 44 form an integral structure extending completely through the corresponding through hole 50, whether the two opposite elastomeric elements 44 are formed integrally or attached together.

The elastomeric elements 44 may be fabricated from any suitable material(s) that enable the elastomeric elements 44 to function as described herein, such as, but not limited to, a polymer, silicone rubber, flourosilicone rubber, polyepoxide, polyimide, polybutadiene, neoprene, ethylene propylene diene monomer (EPDM), a thermoplastic elastomer, polystyrene, and/or the like. The elastomeric elements 44 may each have any suitable shape that enables the elastomeric elements 44 to function as described herein, such as, but not limited to, a cone, a truncated cone (a frustoconical shape), a pyramid, a truncated pyramid, a prism, a hemisphere, and/or the like. In the exemplary embodiment, each of the elastomeric elements 44 includes a conical shape with a rounded tip at the end portion 48 and a stem portion 52 that is dimensioned smaller than the remainder of the base portion 46 for reception within a corresponding one of the through holes 50.

The substrate 34 may be fabricated from any suitable material(s) that enables the substrate 34 to function as described herein, such as, but not limited to polyimide, polyester, epoxy, other materials having a low and uniform dielectric constant, electrically conductive materials (such as, but not limited to, stainless steel and/or the like), and/or the like. In some embodiments, the substrate 34 is fabricated entirely from one or more materials having a low and uniform dielectric constant (excluding any electrically conducting elements, traces, and the like, e.g., the elements 58, the material 64, and the traces 67). Alternatively, the substrate 34 is fabricated from one or more conductive materials, such as, but not limited to, stainless steel and/or the like, that is at least partially covered with one or more materials having a low and uniform dielectric constant. The dielectric properties of the substrate 34 facilitate shielding the electrical contacts 32 from each other. Additionally or alternatively, each electrical contact 32 may be at least partially covered by one or more shielding layers of any suitable material(s).

The electrical contacts 32 may each be referred to herein as an electrical contact section. The electrical contacts 32 are substantially identical, except for their locations on the corresponding side portion 36 or 38 of the substrate 34. Specifically, each electrical contact 32 on the side portion 36 includes a substantially identical electrical contact 32 opposite thereto on the side portion 34. Each electrical contact 32 extends between a pair of opposite end portions 54 and 56

(FIGS. 2 and 4). The end portions 54 and 56 each engage a corresponding electrically conductive element 58 of the substrate 34 such that the end portions 54 and 56 are electrically connected to the corresponding electrically conductive element 58. Each pair of electrical contacts 32 located opposite one another on the side portions 36 and 38 of the substrate 34 is electrically connected together via one or more through holes 60 (FIG. 4) that extend through the substrate 34 from the side portion 36 to the side portion 38. Specifically, each electrically conductive element 58 extends on the surface 40 or 42 of the substrate 34 about at least a portion of a perimeter of the corresponding through hole 60. Interior surfaces 62 of the substrate 34 that define the through holes 60 are coated with an electrically conductive material 64 (FIG. 4). The electrically conductive material 64 of each through hole electrically connects the corresponding pair of electrically conductive elements 58 that are located opposite one another on the substrate side portions 36 and 38 and that extend about the circumference of the through hole 60. Optionally, some or all of the coated through holes 60 are grounded using any suitable means, such as, but not limited to, ground traces 67 (FIGS. 2 and 4) on the substrate 34 that are connected to the elements 58 and/or the material 62.

In the exemplary embodiment of FIGS. 2-4, the end portions 54 of each pair of opposite electrical contacts 32 are electrically connected together via the corresponding elements 58, material 64, and through hole 60, and the end portions 56 of each pair of opposite electrical contacts 32 are electrically connected together via the corresponding elements 58, material 64, and through hole 60. Alternatively, only the end portions 54 or the end portions 56 of one or more pairs of opposite electrical contacts 32 are electrically connected together. In such an alternative embodiment, the substrate 34 may not include a through hole 60 (and/or the corresponding electrically conductive material 64) that corresponds to the end portions 54 or 56 that are not electrically connected. Moreover, in an alternative embodiment, the electrically conductive elements 58 do not extend on the corresponding exterior surface 40 or 42, but rather the elements 58 are defined by the portion of the through hole material 64 that is exposed on the corresponding side portion 36 or 38.

Each electrical contact 32 includes an intermediate portion 66 that extends between the end portions 54 and 56. The intermediate portion 66 extends over the end portion 48 of the corresponding elastomeric element 44. As will be described below, a surface 68 of the intermediate portion 66 that extends over the end portion 48 of the corresponding elastomeric element 44 engages a corresponding electrical contact 22 or 24 of the corresponding array 18 or 20. In the exemplary embodiment, each pair of the electrically conductive elements 58 that are engaged by the end portions 54 and 56 of a corresponding electrical contact 32 are located on the corresponding side portion 36 or 38 of the substrate 34 opposite one another and on opposite sides of the corresponding elastomeric element 44. Accordingly, each electrical contact 32 follows a generally straight path between the corresponding elements 58 along a corresponding plane 70 or 72 defined by the substrate surface 40 and 42, respectively. However, each pair of corresponding electrically conductive elements 58 may have any suitable location relative to the corresponding elastomeric element 44, and the corresponding electrical contact 32 may have any suitable shape, that enables the intermediate portion 66 of the corresponding electrical contact 32 to extend over at least a portion of the end portion 48 of the corresponding elastomeric element 44. Other exemplary paths/shapes of the electrical contacts 32 include, but are not limited to, embodiments wherein a pair of the electrically conductive elements 58 that are engaged by the end portions 54 and 56 of a corresponding electrical contact 32 are not located opposite one another and on opposite sides of the corresponding elastomeric element 44 such that the path of the corresponding electrical contact 32 between the pair of corresponding elements 58 and along the corresponding plane 70 or 72 includes a bend having any angle.

The electrical contacts 32 may each have any suitable shape that enables the electrical contact 32 to extend over the end portion 48 of the corresponding elastomeric element 44. In the exemplary embodiment, the electrical contacts 32 each have a ribbon-shape. Another exemplary shape of one or more of the electrical contacts 32 is cylindrical, such that the electrical contact(s) 32 is a wire. Optionally, a protective coating (not shown) may be applied to at least a portion of one or more of the end portions 48 to facilitate preventing the corresponding electrical contact 32 from being at least partially embedded in the end portion 48. The coating may be any impermeable or semi-impermeable coating that increases a stiffness of the elastomeric element 44, such as, but not limited to, a dielectric material, a ceramic, a ceramic slurry (such as, but not limited to, alumina, and/or a metal (such as, but not limited to, aluminum, iron, cobalt, nickel, copper, silver, gold, zinc, tin, indium, and/or the like), and/or the like. In addition or alternative to the coating, at least a portion of one or more of the end portions 48 may be cross-linked to facilitate preventing the corresponding electrical contact 32 from being at least partially embedded in the end portion 48.

The electrical contacts 32, the electrically conductive elements 58, and the electrically conductive material 64 may each be fabricated from any suitable material(s) that enable the contact 32, the element 58, and the material 64 to function as described herein, such as, but not limited to, copper, aluminum, silver, nickel, palladium, platinum, rhodium, rhenium, tin, and/or gold. Non-noble metals covered with a conductive layer may be used as a base material(s) to provide strength and/or rigidity. Such non-noble metals may be covered with a barrier metal that is covered with a surface structure of a noble metal to ensure chemical inertness and provide suitable asperity distribution to facilitate good metal-to-metal contact.

Figure 5:
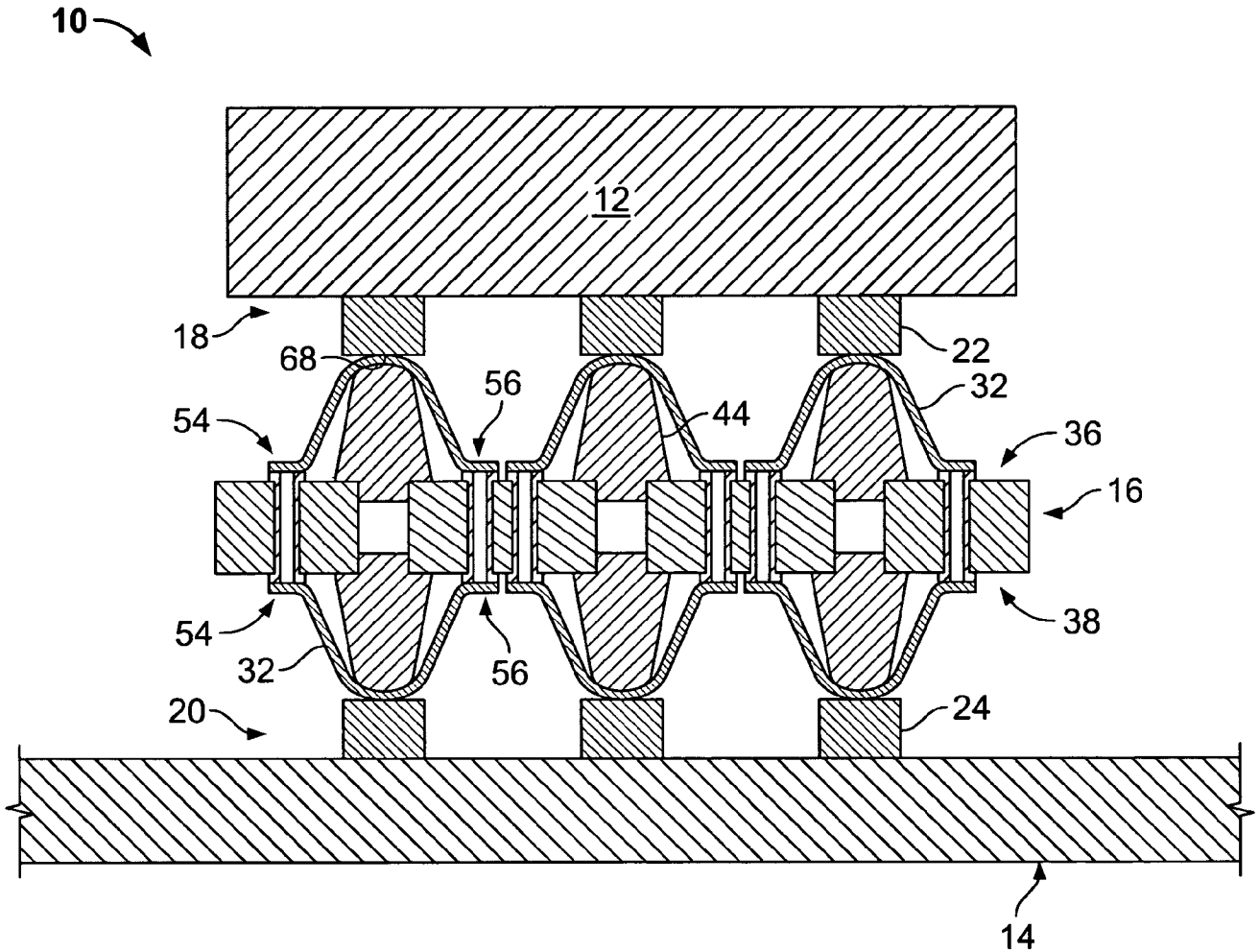
FIG. 5 is a cross-sectional view of the electrical component assembly shown in FIG. 1.

FIG. 5 is a cross-sectional view of the electrical component assembly 10. In operation, the interposer 16 is positioned between and aligned with the electrical components 12 and 14. When the electrical components 12 and 14 are mechanically connected together, the electrical contacts 32 of the interposer 16 electrically connect each electrical contact 22 of the array 18 with its corresponding electrical contact 24 of the array 20. Specifically, each surface 68 of the intermediate portion 66 of each electrical contact 32 on the side portion 36 of the substrate 34 is in electrical contact with the corresponding electrical contact 22 of the array 18 of the electrical component 12. Similarly, each surface 68 of the intermediate portion 66 of each electrical contact 32 on the side portion 38 of the substrate 34 is in electrical contact with the corresponding electrical contact 24 of the array 20 of the electrical component 14. Electrical connection between the end portions 54 and/or the end portions 56 of each pair of opposite electrical contacts 32 located on the opposite side portions 36 and 38, via the electrically conductive elements 58 and the electrically conductive material 64, completes the electrical connection between the electrical components 12 and 14. When the electrical components 12 and 14 are mechanically connected together as shown in FIG. 5, the elastomeric elements 44 of the interposer 16 are compressed between the opposing arrays 18 and 20 and therefore apply a mechanical force to the electrical contacts 22 and 24 of the arrays 18 and 20, respectively, to facilitate establishing and maintaining reliable electrical contact between the arrays 18 and 20. The elastomeric properties of the elastomeric elements 44 may also allow for some degree of nonplanarity between, and/or misalignment of, the electrical components 12 and 14.

Figure 6:
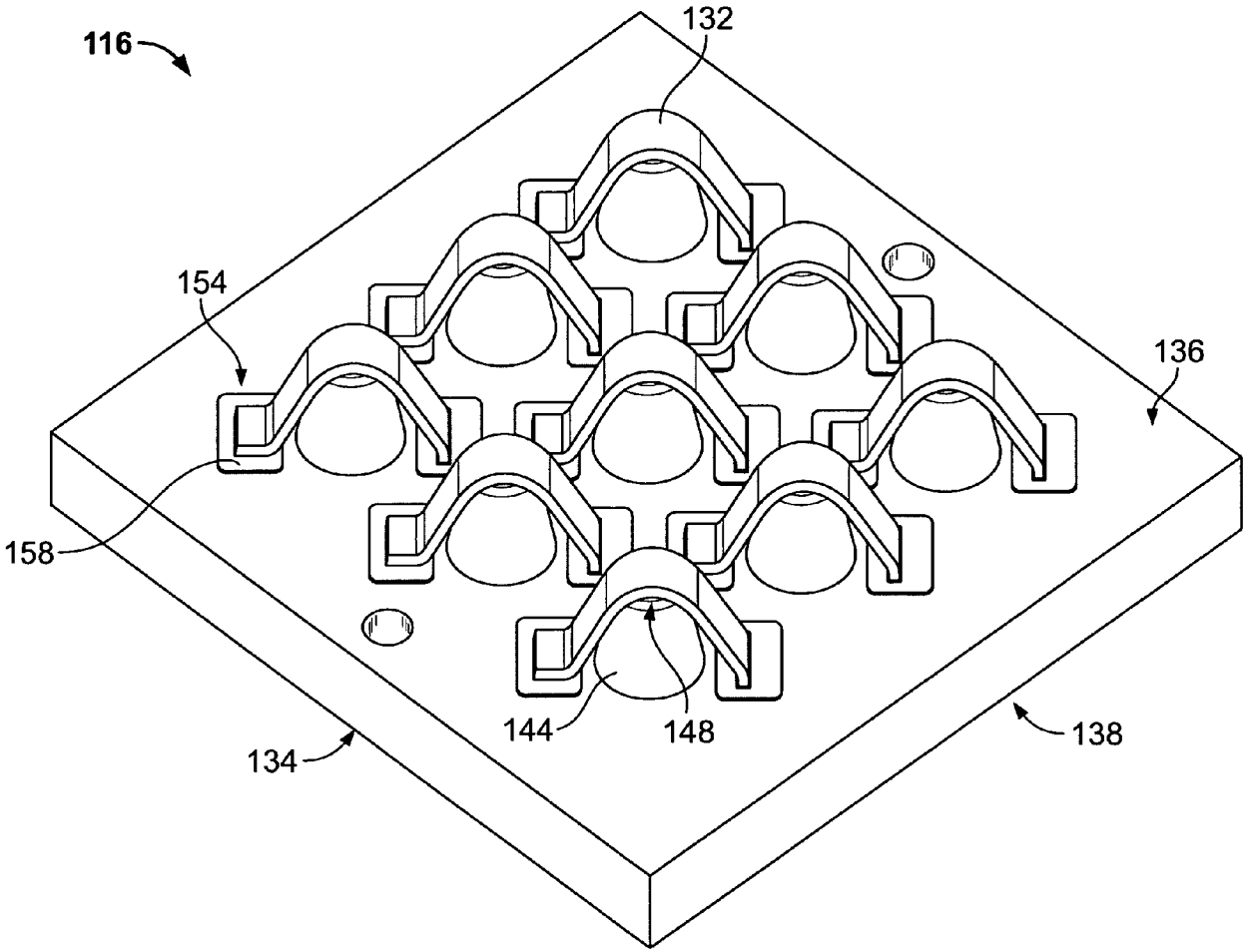
FIG. 6 is a perspective view of an exemplary alternative embodiment of an interposer.
Figure 7:
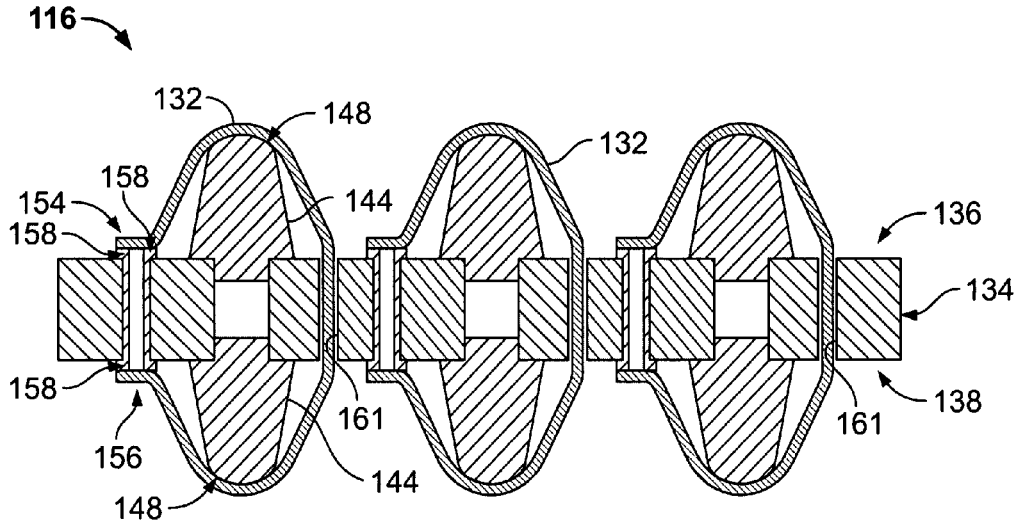
FIG. 7 is a cross-sectional view of the interposer shown in FIG. 6.

FIG. 6 is a perspective view of an exemplary alternative embodiment of an interposer 116. FIG. 7 is a cross-sectional view of the interposer 116. The interposer 116 is similar to the interposer 16 (FIGS. 1-4), except that rather than using pairs of separate electrical contacts 32 (FIGS. 1-4) on opposite side portions 36 and 38 (FIGS. 1-4) of a substrate 34 (FIGS. 1-4) that are indirectly electrically connected together, the interposer 116 uses a single electrical contact 132 that extends over both of a pair of opposite side portions 136 and 138 of a substrate 134. Each of the electrical contacts 132 may be referred to herein as having first and second electrical contact sections. Specifically, each electrical contact 132 extends between a pair of opposite end portions 154 and 156. The end portion 154 of each of the electrical contacts 132 is electrically connected to a corresponding electrically conductive element 158 of the side portion 136 of the substrate 134. Each electrical contact 132 extends from the corresponding electrically conductive element 158 of the side portion 136, over an end portion 148 of a corresponding elastomeric element 144 of the side portion 136, through a through hole 161 (FIG. 7) that extends through the substrate 134 from the side portion 136 to the side portion 138, over the end portion 148 of a corresponding elastomeric element 144 of the side portion 138, and to a corresponding electrically conductive element 158 of the side portion 138. The end portion 156 of each electrical contact 132 is electrically connected to the corresponding electrically conductive element 158 of the side portion 138. The electrically conductive elements 158 of the side portions 136 and 138 may optionally be indirectly electrically connected together as described above with respect to the electrically conductive elements 58 (FIGS. 2-4).

Figure 8:
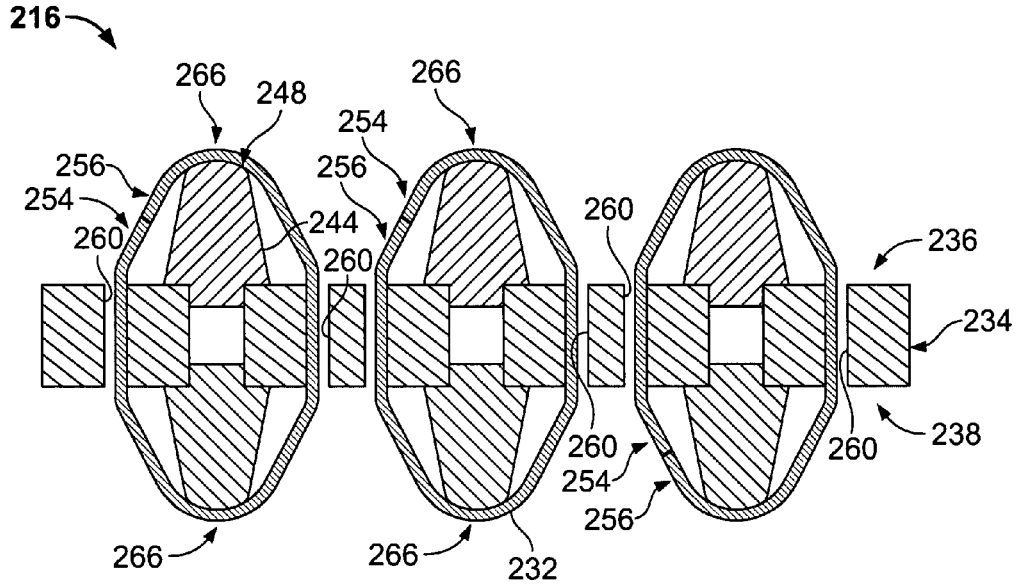
FIG. 8 is a cross-sectional view of an exemplary alternative embodiment of an interposer.

FIG. 8 is a cross-sectional view of another exemplary alternative embodiment of an interposer 216. The interposer 216 includes a plurality of electrical contacts 232. Each of the electrical contacts 232 may be referred to herein as having first and second electrical contact sections. Each electrical contact 232 extends between a pair of opposite end portions 254 and 256. The end portions 254 and 256 are directly connected together. Each electrical contact 232 extends through a corresponding pair of through holes 260 of a substrate 234. Each of the through holes 260 extends through the substrate 234 from a side portion 236 to a side portion 238 of the substrate 234. Each electrical contact 232 includes a pair of intermediate portions 266 that each extends over the end portion 248 of a corresponding elastomeric element 244 of a corresponding one of the side portions 236 and 238.

Figure 9:
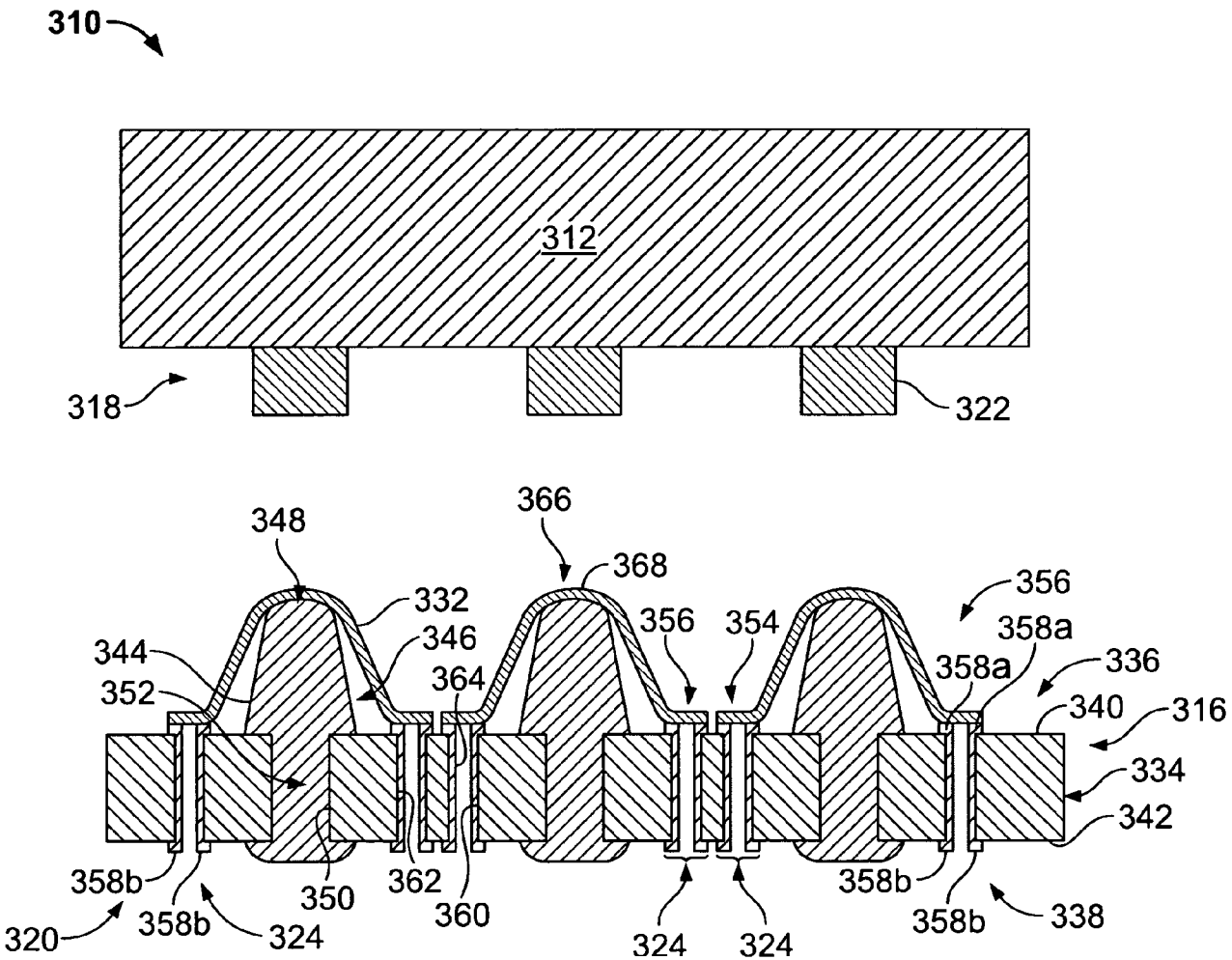
FIG. 9 is an exploded cross-sectional view of an exemplary alternative embodiment of an electrical component assembly.

FIG. 9 is an exploded cross-sectional view of an exemplary alternative embodiment of an electrical component assembly 310. The assembly 310 includes an electrical component 312, a circuit board 316, and a plurality of electrical contacts 332 for electrically connecting the electrical component 312 to the circuit board 316. The electrical component 312 and the circuit board 316 each include a respective array 318 and 320 of a plurality of respective electrical contacts 322 and 324. The arrays 318 and 320 may each be any suitable type of array of electrical contacts that enables operative electrical connection between the electrical component 312 and the circuit board 316, such as, but not limited to, Pin Grid Arrays (PGAs), Land Grid Arrays (LGAs), and/or Ball Grid Arrays (BGAs). Moreover, the arrays 318 and 320 may have any suitable configuration, arrangement, and/or pattern of electrical contacts that enables operative electrical connection between the electrical component 312 and the circuit board 316. The circuit board 316 includes a substrate 334 having opposite side portions 336 and 338. The side portions 336 and 338 each include opposite exterior surfaces 340 and 342, respectively, of the substrate 334. The substrate 334 also includes a plurality of elastomeric elements 344 extending outwardly from the substrate 334 on the side portion 336.

Each elastomeric element 344 extends outwardly from a base portion 346 thereof at the substrate 334 to an end portion 348 thereof that is opposite the base portion 346. In the exemplary embodiment, the substrate 334 includes a plurality of through holes 350 that each receives a stem portion 352 of the base portion 346 of the corresponding elastomeric elements 344. The holes 350 are arranged in a pattern that substantially matches the pattern of the electrical contact array 318 of the electrical component 312. Optionally, and as in the exemplary embodiment of FIG. 9, the elastomeric elements 344 may each extend completely through the corresponding through hole 350 such that a portion of the stem portion 352 extends along the surface 342 of the substrate 334 to facilitate stabilizing and/or to facilitate holding the elastomeric elements 344 on the substrate 334.

Each electrical contact 324 includes a pair of opposite electrically conductive elements 358*a* and 358*b* on the opposite side portions 336 and 338 of the substrate 334. Each pair of electrically conductive elements 358*a* and 358*b* are electrically connected together via one or more through holes 360 that extend through the substrate 334 from the side portion 336 to the side portion 338. Specifically, each electrically conductive element 358*a* extends on the surface 340 of the substrate 334 about at least a portion of a perimeter of the corresponding through hole 360. Similarly, each electrically conductive element 358*b* extends on the surface 342 of the substrate 334 about at least a portion of a perimeter of the corresponding through hole 360. Each electrical contact 324 includes an electrically conductive material 364 coated on a corresponding interior surface 362 of the substrate 334 that defines the corresponding through hole 360. The electrically conductive material 364 of each through hole 360 electrically connects the corresponding pair of electrically conductive elements 358*a* and 358*b* that are located opposite one another on the substrate side portions 336 and 338 and that extend about the circumference of the through hole 360.

Each electrical contact 332 extends between a pair of opposite end portions 354 and 356. The end portions 354 and 356 each engage a corresponding electrically conductive element 358*a* on the side portion 336 of the substrate 334 such that the end portions 354 and 356 are electrically connected to the corresponding electrically conductive element 358*a* of the corresponding electrical contact 324. The electrical contacts 332 are each electrically connected to a corresponding electrically conductive element 358*b* of the electrical contacts 324 on the side portion 338 of the circuit board 316 via the corresponding electrically conductive element 364 of the corresponding electrical contact 324. Each electrical contact 332 includes an intermediate portion 366 that extends between the end portions 354 and 356. The intermediate portion 366 extends over the end portion 348 of the corresponding elastomeric element 344. A surface 368 of the intermediate portion 366 that extends over the end portion 348 of the corresponding elastomeric element 344 engages a corresponding electrical contact 322 of the array 318 of the electrical component 312. The electrically conductive elements 358*b* on the side portion 338 of the substrate 334 may be electrically connected to corresponding electrical contacts (not shown) of any other suitable electrical component (not shown) (such as, but not limited to, another circuit board, integrated circuits, electrical modules, and/or other electrical devices) to electrically connect the electrical component 312 with the other suitable electrical component.

In an alternative embodiment, only the end portions 354 or the end portions 356 of one or more of electrical contacts 332 are electrically connected to an electrically conductive element 358*b* on the side portion 338 of the substrate. In such an alternative embodiment, the substrate 334 may not include a through hole 360 (and/or the corresponding electrically conductive material 364 and/or the corresponding electrically conductive element 258*b*) that corresponds to the end portions 354 or 356 that are not electrically connected to an element 358*b*. Moreover, in an alternative embodiment, the electrically conductive elements 358*a* and/or 358*b* do not extend on the corresponding exterior surface 40 or 42, but rather the elements 358*a* and/or 358*b* are defined by the portion of the through hole material 364 that is exposed on the corresponding side portion 36 or 38.

The embodiments described herein provide an electrical connector having an electrical contact that may have a higher current carrying capability than known elastomeric electrical contacts while maintaining a predetermined elastic working range of an elastomeric element of the connector.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. For example, although specific sensor elements are described and/or illustrated with specific attachment devices, each described and/or illustrated sensor element may be used with any of the described and/or illustrated attachment devices as is appropriate. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

While the invention has been described in terms of various specific embodiments, those skilled in the art will recognize that the invention can be practiced with modification within the spirit and scope of the claims.

What is claimed is:

1. An electrical connector comprising:

a substrate comprising first and second electrically conductive elements;

an elastomeric element extending outwardly from the substrate, the elastomeric element extending outwardly from a base portion thereof at the substrate to an end portion thereof that is opposite the base portion; and an electrical contact engaged with the first and second electrically conductive elements of the substrate, the electrical contact having a portion extending over at least a portion of the end portion of the elastomeric element.

2. The electrical connector according to claim 1, wherein at least one of the first or second electrically conductive elements-extends on an exterior surface of the substrate.

3. The electrical connector according to claim 1, wherein at least a portion of at least one of the first or second electrically conductive elements extends on an interior surface of the substrate that defines a through hole of the substrate.

4. The electrical connector according to claim 1, wherein a portion of the electrical contact extends at least partially through a through hole of the substrate.

5. The electrical connector according to claim 1, wherein the first and second electrically conductive elements of the substrate are located on the same side of the substrate.

6. The electrical connector according to claim 1, wherein the first and second electrically conductive elements of the substrate are located on the substrate opposite one another and on opposite sides of the elastomeric element.

7. The electrical connector according to claim 1, wherein the electrical contact engages the first and second electrically conductive elements at respective first and second ends of the electrical contact, the portion of the electrical contact extending over the end portion of the elastomeric element being an intermediate segment of the electrical contact that extends between the first and second ends.

8. The electrical connector according to claim 1, wherein the elastomeric element extends outwardly from the substrate along a central longitudinal axis, the electrical contact extending from the first electrically conductive element to the second electrically conductive element of the substrate along an approximately straight path when viewed from a direction generally parallel to the central longitudinal axis.

9. The electrical connector according to claim 1, wherein the electrical contact comprises a ribbon or a wire.

10. An interposer for electrically connecting a pair of electrical components, said interposer comprising:

a substrate having first and second opposite side portions;

a first elastomeric element extending outwardly from the substrate on the first side portion, the first elastomeric element extending outwardly from a first base portion thereof at the substrate to a first end portion thereof that is opposite the first base portion;

a second elastomeric element extending outwardly from the substrate on the second side portion, the second elastomeric element extending outwardly from a second base portion thereof at the substrate to a second end portion thereof that is opposite the second base portion;

a first electrical contact section engaging a first electrically conductive element of the first side portion of the substrate, the first electrical contact section extending outwardly from the first electrically conductive element over at least a portion of the first end portion of the first elastomeric element and back to the substrate; and a second electrical contact section engaging a second electrically conductive element of the second side portion of the substrate, the second electrical contact section extending over at least a portion of the second end portion of the second elastomeric element.

11. The interposer according to claim 10, wherein the substrate comprises a through hole extending through the substrate from the first side portion to the second side portion, the first and second electrical contact sections each extending partially within the through hole and being one of integrally formed and connected together such that the first and second electrical contact sections form a single electrical contact that extends from the first side portion of the substrate through the through hole to the second side portion of the substrate.

12. The interposer according to claim 10, wherein the first electrically conductive element engaged by the first electrical contact section extends on a first exterior surface of the substrate on the first side portion of the substrate, and the second electrically conductive element engaged by the second electrical contact section extends on a second exterior surface of the substrate on the second side portion of the substrate.

13. The interposer according to claim 10, wherein the first and second electrically conductive elements are electrically connected via a through hole extending through the substrate from the first side portion to the second side portion.

14. The interposer according to claim 10, further comprising a third electrically conductive element of the first side portion of the substrate, the first electrical contact section extending back to the substrate at an end of the first electrical contact section that is engaged with the third electrically conductive element.

15. The interposer according to claim 14, wherein the first and third electrically conductive elements are electrically connected via a corresponding through hole within the substrate.

16. The interposer according to claim 14, wherein the first and third electrically conductive elements of the substrate are located on the first side portion of the substrate opposite one another and on opposite sides of the first elastomeric element.

17. The interposer according to claim 10, wherein the first electrical contact section comprises an end engaged with the first electrically conductive element and an intermediate segment that extends from the end and over the first end portion of the first elastomeric element is an intermediate portion, the first electrical contact section further comprising another segment that extends from the intermediate segment back to the substrate.

18. The interposer according to claim 10, wherein at least one of the first or second electrical contact sections comprises a ribbon or a wire.

19. The interposer according to claim 10, wherein the first elastomeric element extends outwardly from the substrate along a central longitudinal axis, the first electrical contact section extending outwardly from the first electrically conductive element over at least a portion of the first end portion of the first elastomeric element and back to the substrate along an approximately straight path when viewed from a direction generally parallel to the central longitudinal axis.

* * * * *